United States Patent [19]

Socha

[11] 4,406,236

[45] Sep. 27, 1983

[54] NEEDLE SHIFT WARNING ARRANGEMENT IN AN ELECTRONICALLY CONTROLLED SEWING MACHINE

[75] Inventor: Robert J. Socha, Edison, N.J.

[73] Assignee: The Singer Company, Stamford, Conn.

[21] Appl. No.: 450,591

[22] Filed: Dec. 17, 1982

[51] Int. Cl.[3] ..... D05B 3/02

[52] U.S. Cl. ..... 112/158 E; 112/158 F; 112/321

[58] Field of Search ..... 112/158 E, 158 F, 321, 112/277, 49

[56] References Cited

U.S. PATENT DOCUMENTS 4,075,961 2/1978 Harris ..... 112/277

4,123,981 11/1978 Brown ..... 112/158 E 4,135,462 1/1979 Brown ..... 112/158 E 4,342,271 8/1982 Socha ..... 112/158 F X

FOREIGN PATENT DOCUMENTS 39-2332664 10/1964 Japan .

57-25894 2/1982 Japan .

*Primary Examiner*—Peter P. Nerbun

*Attorney, Agent, or Firm*—David L. Davis; Robert E. Smith; Edward L. Bell

[57] ABSTRACT

An electronically controlled sewing machine includes the capability for sewing extended bight width patterns. When certain bight width data is recognized as needle shift data, an indication of same is provided to the sewing machine operator.

3 Claims, 2 Drawing Figures

Fig. 1.
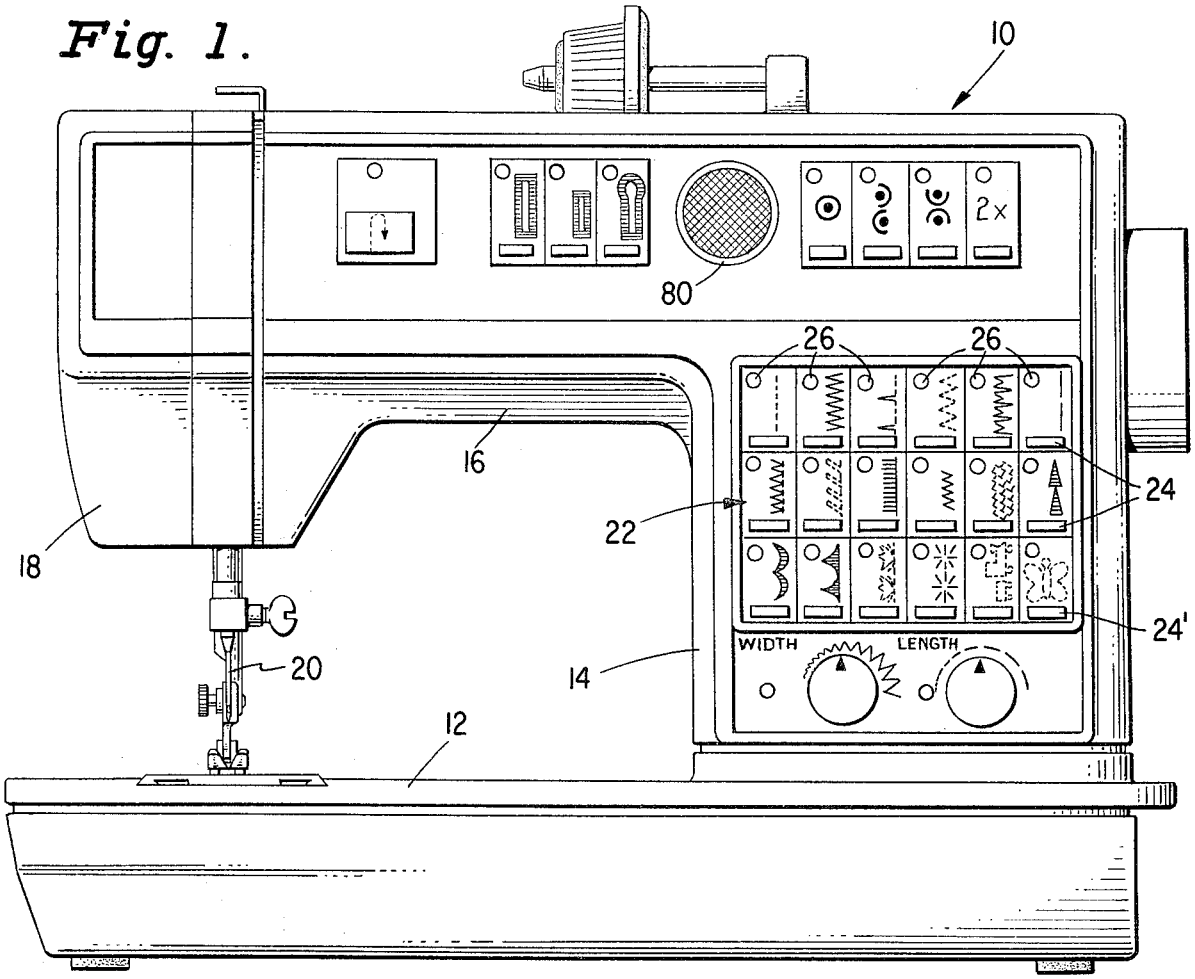
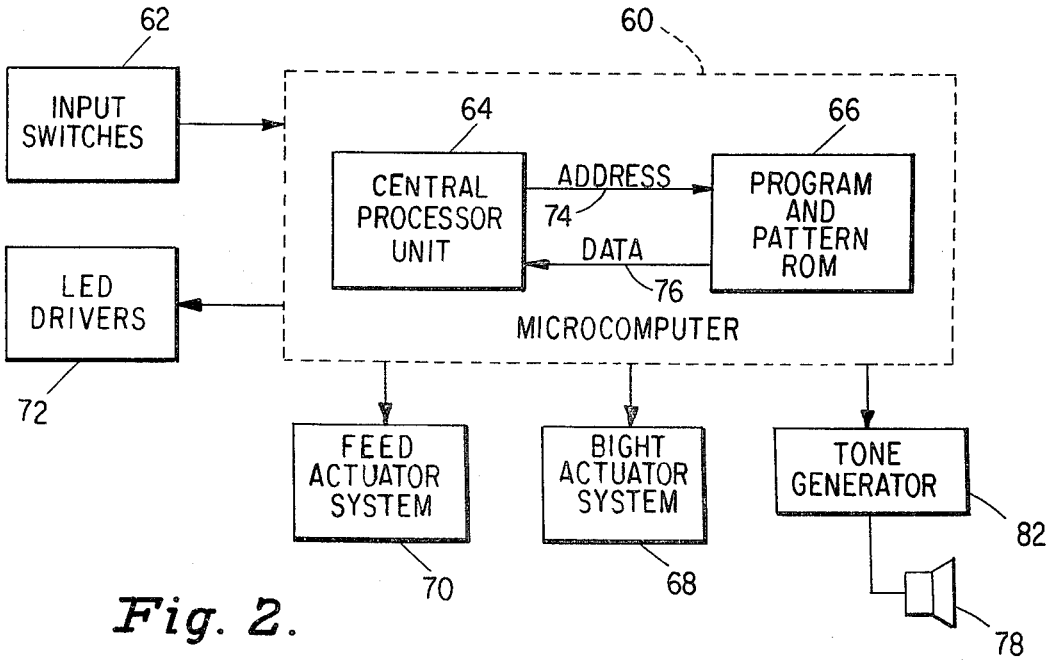
Fig. 2.

NEEDLE SHIFT WARNING ARRANGEMENT IN AN ELECTRONICALLY CONTROLLED SEWING MACHINE

DESCRIPTION

BACKGROUND OF THE INVENTION

This invention relates to sewing machines and, more particularly, to electronically controlled sewing machines.

Sewing machines employing sophisticated electronic technology for the storage and subsequent retrieval of stitch pattern information for a multiplicity of patterns have enjoyed great commercial success in recent years. One great advantage of the use of an electronically controlled sewing machine is in its simplicity of operation and control, as perceived by the user. With the recent availability of relatively low cost microcomputers, electronically controlled sewing machines incorporating such a device have greatly increased the versatility of control afforded to the sewing machine operator. Accordingly, sewing machine designers increasingly strive to improve the versatility of the sewing machine while at the same time attempting to keep the number of operator manipulatable control elements to a minimum, so that the operator perceives the use of the machine as relatively simple in nature.

One manner of improving the versatility of such a sewing machine is to increase the number and type of patterns which may be sewn by the sewing machine. One type of pattern which it would be desirable to provide for the user's selection is what is termed an extended bight width pattern. Such a pattern is one which may be of arbitrary dimension in the direction lateral to the direction of fabric feeding and is accomplished by means of needle shifting. Needle shifting is accomplished by laterally jogging the needle when the needle is engaged with the work material, as disclosed for example, in U.S. Pat. Nos. 4,123,981 and 4,135,462.

A problem that may arise when sewing an extended bight width pattern is that needle shifting of the work material may catch the operator unaware, causing the operator to lose control of the work material, which may result in a distortion of the pattern being sewn.

It is therefore an object of this invention to provide an arrangement whereby an operator is informed of an impending needle shift.

SUMMARY OF THE INVENTION

The foregoing and additional objects are attained in accordance with the principles of this invention by providing an electronically controlled sewing machine arranged to sew extended bight width patterns by changing the bight data applied to the bight actuator circuit of the sewing machine while the sewing machine needle is in engagement with the work material, the sewing machine including means for recognizing that data which is applied to the bight actuator circuit while the needle is in engagement with the work material is to be changed and means responsive to such recognition by the recognizing means for providing an indication to the sewing machine operator.

BRIEF DESCRIPTION OF THE DRAWINGS

The foregoing will be more readily apparent upon reading the following description in conjunction with the drawings in which like elements in different figures thereof have the same reference character applied thereto and wherein:

FIG. 1 is a front elevational view of an illustrative sewing machine in which the invention may be incorporated; and FIG. 2 illustrates a general block diagram of a microcomputer based control system for the sewing machine of FIG. 1.

DETAILED DESCRIPTION

Referring now to the drawings, FIG. 1 shows a sewing machine designated generally by the reference numeral 10. The sewing machine 10 includes a work supporting bed 12, a standard 14, a bracket arm 16 and a sewing head 18. The sewing machine stitch instrumentalities include a needle 20 capable of being endwise reciprocated and laterally jogged to form zig zag stitches and a work feed dog (not shown) operating upwardly through slots formed in a throat plate on the bed 12 to support the work across the bed 12 between needle penetrations. The pattern of stitches produced by operation of the sewing machine 10, i.e., the positional coordinates of each stitch penetration, may be influenced, for example, by data stored in a memory unit and extracted in timed relation with the operation of the sewing machine 10, as is well known in the art.

On the front panel of the sewing machine 10 there is provided an input means whereby the operator can affect control of the functions of the sewing machine. This input means includes switches and dials whereby the operator may select a pattern to be sewn by the sewing machine as well as effecting modifications to the pattern. Pattern selection is effected illustratively through an array 22 of pushbuttons switches 24, each of which corresponds to a pattern of stitches, the information for forming which is stored within the memory of the sewing machine 10. Associated with each of the pushbutton switches 24 is a pictorial representation of the pattern as it would be sewn by the sewing machine upon actuation of that switch. Indicating means for indicating to an operator the status of each of the various functions which may be selected is also provided on the front panel of the sewing machine 10. Illustratively, this takes the form of a plurality of light emitting diodes (LED's) 26 each in close proximity to its respective input switch.

FIG. 2 shows a general block diagram of a microcomputer based controller for an electronic stitch pattern sewing machine, which controller may be utilized to control the operation of the sewing machine 10 (FIG. 1) and which operates in accordance with the principles of this invention. Accordingly, the microcomputer 60 receives input signals from the input switches 62 indicative of the functions the sewing machine operator desires to be performed by the sewing machine 10. The input switches 62 include the pattern selection switches 24. The microcomputer 60 includes an internal central processor unit (CPU) 64 and a program and pattern ROM 66. The CPU 64 obtains from the ROM 66, in timed relation with the operation of the sewing machine 10, pattern data for controlling the bight actuator system 68 and the feed actuator system 70. The bight actuator system 68 and the feed actuator system 70 are similar in construction and are adapted to convert a digital code word from the microcomputer 60 into a mechanical position which locates the sewing machine needle 20 in a conventional stitch forming instrumentality and provides a specific work feed for each needle penetration, respectively, as is well known in the art. The microcomputer 60 also provides signals to the LED drivers 72 to control the illumination of the LED's 26 (FIG. 1) to indicate the function selected by the sewing machine operator. Illustratively, the microcomputer 60 is a type TMS 7040 microcomputer manufactured by Texas Instruments wherein the CPU 64 provides addresses to the ROM 66 over the lines 74 and receives in return bytes of data and program over the lines 76. In addition to the ROM 66, the microcomputer 60 also includes read/write memory and registers which the CPU 64 utilizes during execution of its internal program stored in the ROM 66.

Illustratively, the sewing machine 10 includes data within the ROM 66 for sewing an extended bight width pattern such as a butterfly, which sewing may be initiated by actuation of the switch 24'. In order to sew such a pattern, the CPU 64 must recognize when the bight data stored in the ROM 66 for a particular stitch is to be interpreted as needle shift data so that data applied to the bight actuator system 68 when the needle 20 is penetrating the work material is changed. Illustratively, the ROM 66 stores the bight data as 5 bit digital code words. Accordingly, there are 32 possible bight codes. However, not all of these codes are utilized. Thus, the microcomputer 60 is programmed such that a first normally unused bight code is utilized to indicate a needle shift to the left and a second normally unused bight code is utilized to indicate a needle shift to the right. When the code indicating needle shift to the left is recognized, the microcomputer 60 causes the bight actuator system 68 to move the needle 20 all the way to the left prior to penetrating the work material and after the work material is penetrated, the bight actuator system 68 is caused to move the needle 20 all the way to the right, thus causing the work material to be shifted. Conversely, when the code indicating needle shift to the right is recognized, the bight actuator system 68 is caused to move the needle 20 all the way to the right prior to penetrating the work material and is then caused to move the needle 20 all the way to the left while the needle 20 is in engagement with the work material.

The sewing machine 10 also includes a speaker 78 illustratively mounted behind a grill 80. The input to the speaker 78 is a tone generator 82 controlled by appropriate signals from the microcomputer 60. When the microcomputer 60 recognizes bight data corresponding to needle shifting, it causes the tone generator 82 to generate an input to the speaker 78 which is converted to an audible warning to the operator. Thus, the operator will hear a "beep" immediately prior to a needle shift operation. Alternatively, the microcomputer 60 can cause the LED drivers 72 to provide a visible indication to the operator of an impending needle shift. Thus, the operator is not caught unawares by a needle shift operation. Typically, an extended bight width pattern is sewn at a relatively slow sewing speed so that the warnings supplied by the sewing machine 10 are effective.

Accordingly, there has been disclosed an arrangement for providing a warning to an operator of an impending needle shift operation. It is understood that the above-described embodiment is merely illustrative of the application of the principles of this invention. Numerous other embodiments may be devised by those skilled in the art without departing from the spirit and scope of this invention, as defined by the appended claims.

I claim:

1. In an electronically controlled sewing machine arranged to sew extended bight width patterns by changing the bight data applied to the bight actuator circuit of said sewing machine while the sewing machine needle is in engagement with work material;

means for recognizing that data which is applied to the bight actuator circuit while the needle is in engagement with work material is to be changed; and warning means responsive to such recognition by said recognizing means for providing an indication to the operator of said sewing machine.

2. The sewing machine according to claim 1 wherein said warning means includes means for providing an audible indication.

3. The sewing machine according to claim 1 wherein said warning means includes means for providing a visual indication.

* * * * *